US007441663B2

(12) United States Patent
Osborn

(10) Patent No.: US 7,441,663 B2
(45) Date of Patent: Oct. 28, 2008

(54) TRAY ASSEMBLY HAVING HINGED DIVIDERS

(75) Inventor: Mark Osborn, Vienna, VA (US)

(73) Assignee: The United States Postal Service, Washington, DC (US)

( * ) Notice: Subject to any disclaimer, the term of this patent is extended or adjusted under 35 U.S.C. 154(b) by 308 days.

(21) Appl. No.: 10/830,297

(22) Filed: Apr. 23, 2004

(65) Prior Publication Data

US 2005/0115972 A1 Jun. 2, 2005

Related U.S. Application Data

(60) Provisional application No. 60/465,105, filed on Apr. 24, 2003.

(51) Int. Cl.
*B07C 7/02* (2006.01)

(52) U.S. Cl. ..... 209/614; 209/630; 206/561; 211/10

(58) Field of Classification Search ..... 209/614, 209/630; 211/10; 206/561
See application file for complete search history.

(56) References Cited

U.S. PATENT DOCUMENTS

| | | | | |
|---|---|---|---|---|
| 401,389 | A * | 4/1889 | Stoddard | 312/184 |
| 1,407,073 | A | 2/1922 | Lyons | |
| 3,160,282 | A * | 12/1964 | Gunn | 211/184 |
| 3,905,484 | A * | 9/1975 | Dean et al. | 211/184 |
| 4,248,349 | A * | 2/1981 | Locke et al. | 206/538 |
| 4,366,904 | A * | 1/1983 | Roskvist | 206/425 |
| 4,593,816 | A | 6/1986 | Langenbeck | |
| 6,913,151 | B2 * | 7/2005 | Stevenson | 209/630 |

FOREIGN PATENT DOCUMENTS

| | | |
|---|---|---|
| GB | 836123 | 6/1960 |
| GM | 79 02 986 | 5/1979 |

* cited by examiner

*Primary Examiner*—Joseph C Rodriguez
(74) *Attorney, Agent, or Firm*—Finnegan, Henderson, Farabow, Garrett & Dunner, LLP

(57) ABSTRACT

A tray assembly has a tray and a divider assembly removably connected to the tray. The tray has a base, a first side fixedly attached to the base, a second side fixedly attached to the base and the first side, a third side opposite the first side and fixedly attached to the base and the second side, and a fourth side opposite the second side and pivotally connected to the base.

17 Claims, 4 Drawing Sheets

TRAY ASSEMBLY HAVING HINGED DIVIDERS

REFERENCE TO RELATED APPLICATIONS

This application is based upon and claims the benefit of priority from U.S. Provisional Application No. 60/465,105 by Mark Osborn, filed Apr. 24, 2003, the contents of which are expressly incorporated herein by reference.

FIELD OF THE INVENTION

The present invention relates generally to a tray assembly and, more particularly, to a tray assembly having hinged dividers.

BACKGROUND OF THE INVENTION

The postal service receives millions of pieces of mail every day. This mail is then sorted and transported to various destinations. Historically, the sorting process has included placing a sorting tray on a shelf located below hanging dividers, which provide for divisions within the tray. The mail is placed into the divisions according to destination. After the sorting process is complete, the tray is removed from the shelf and from below the hanging dividers to be loaded on vehicles or emptied into mail bags.

Unfortunately, the existing system may be problematic. For example, a space exists between the hanging dividers and a base of the tray because the hanging dividers are not connected to the tray. This space may be large enough to allow mail to slip underneath the hanging dividers from an intended division into a different division or into no specific division at all. Incorrectly sorted mail may cause delays in the delivery process. In addition, because the hanging dividers do not remain with the tray during delivery, a mail carrier delivering directly from the tray may spend extensive amounts of time re-dividing the mail according to destination during delivery. The extra time spent re-dividing the mail is inefficient.

It is accordingly a primary object of the invention to retain the accuracy of the sorting process and to reduce the time associated with delivery of the sorted mail. These objects are achieved by providing a tray assembly that includes a divider assembly connected to a tray and that can remain with the tray during delivery.

SUMMARY OF THE INVENTION

In accordance with the invention, a tray assembly includes a tray and a divider assembly removably connected to the tray. The tray includes a base, a first side fixedly attached to the base, a second side fixedly attached to the base and the first side, a third side opposite the first side and fixedly attached to the base and the second side, and a fourth side opposite the second side and pivotally connected to the base.

In another aspect, the present disclosure is directed to a method of sorting. The method includes placing a divider assembly within a tray having a base, a first side, a second side, a third side, and a fourth side to form a plurality of divisions within the tray. The method further includes pivoting the fourth side from a first position where a generally closed four-sided structure is formed to a second position where a generally open three-sided structure is formed to reveal a label disposed on an inner surface of the fourth side. The label includes a plurality of sections of information, each of the plurality of sections being aligned with one of the plurality of divisions. The method also includes placing articles within at least one of the plurality of divisions. Each of the articles placed within the at least one of the plurality of divisions is related to the one of the plurality of sections aligned with the at least one of the plurality of divisions. The method additionally includes returning the fourth side to the first position.

Additional objects and advantages of the invention will be set forth in part in the description which follows and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate an embodiment of the invention and together with the description, serve to explain the principles of the invention.

DESCRIPTION OF THE EMBODIMENTS

Reference will now be made in detail to an exemplary embodiment of the invention, an example of which is illustrated in the accompanying drawings. Wherever possible, the same reference numbers will be used throughout the drawings to refer to the same or like parts.

Figure 1:
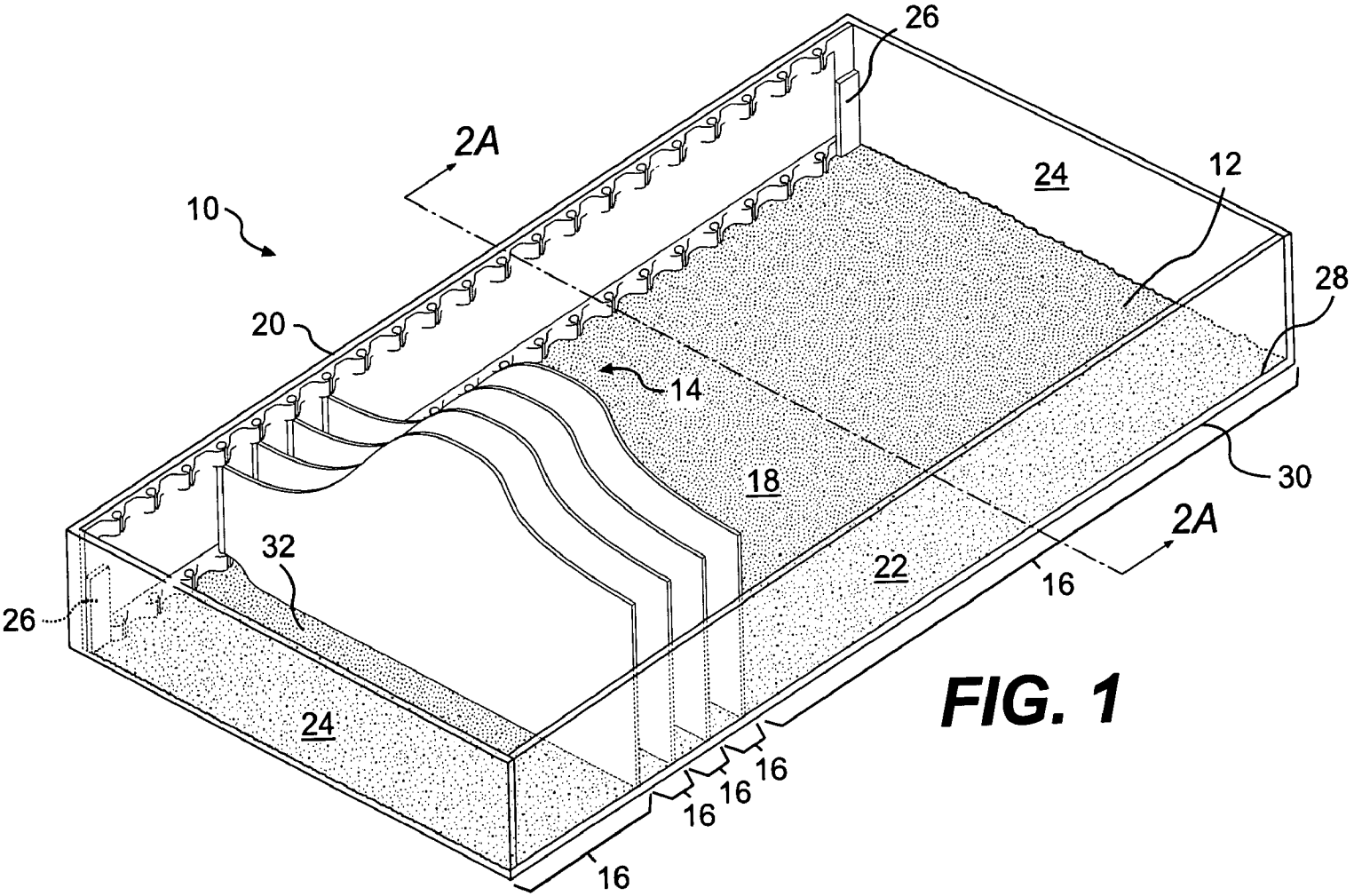
FIG. 1 is a pictorial illustration of a tray assembly according to an exemplary disclosed embodiment.

FIG. 1 represents an exemplary embodiment of a tray assembly 10 that includes a tray 12 and a divider assembly 14. Divider assembly 14 may be configured to engage tray 12 to provide divisions 16 within tray assembly 10. One or both of tray 12 and divider assembly 14 may be formed from a lightweight plastic material such as, for example, a polyolefin such as polypropylene or polyethylene. Alternately, tray assembly 10 may be formed from a material other than a polyolefin such as ABS (Acrylonitrile Butadiene Styrene), cardboard, aluminum, or any other suitable material that is lightweight and can be formed into thin, relatively rigid panels.

Tray 12 may include a base 18, a first side panel 20, a second side panel 22, two end panels 24, and two retaining members 26. Each of first side panel 20 and end panels 24 may be connected to base 18 along one edge. In addition, first side panel 20 may be connected to each end panel 24 along one edge. Each of retaining members 26 may be connected to base 18 and one of end panels 24. Base 18, first side panel 20, end panels 24, and retaining members 26 may be a single integral part formed through an injection molding process, a thermo-forming process, a blow molding process, or through any other appropriate forming or molding process known in the art. It is also contemplated that some or all of the parts may be formed separately and joined together through a fabrication process.

Figure 2A:
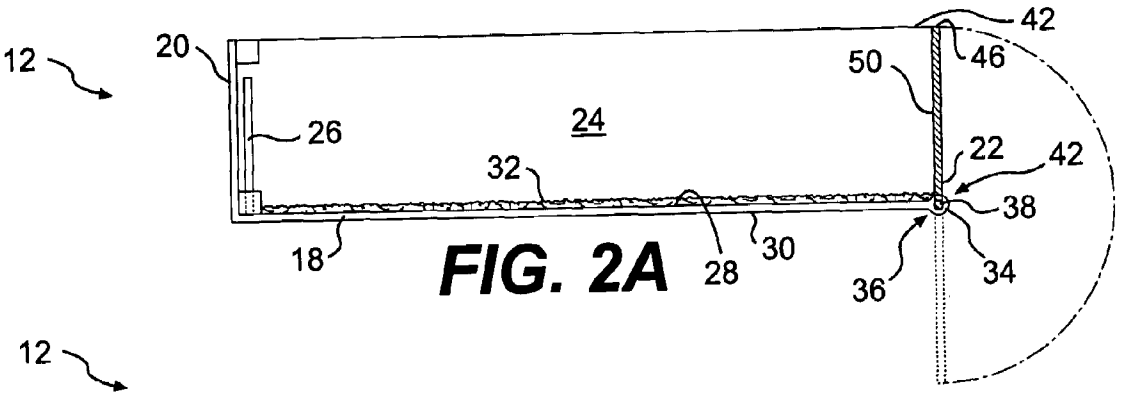
FIG. 2A is a cross-sectional view illustration of a tray according to an exemplary disclosed embodiment.
Figure 2B:
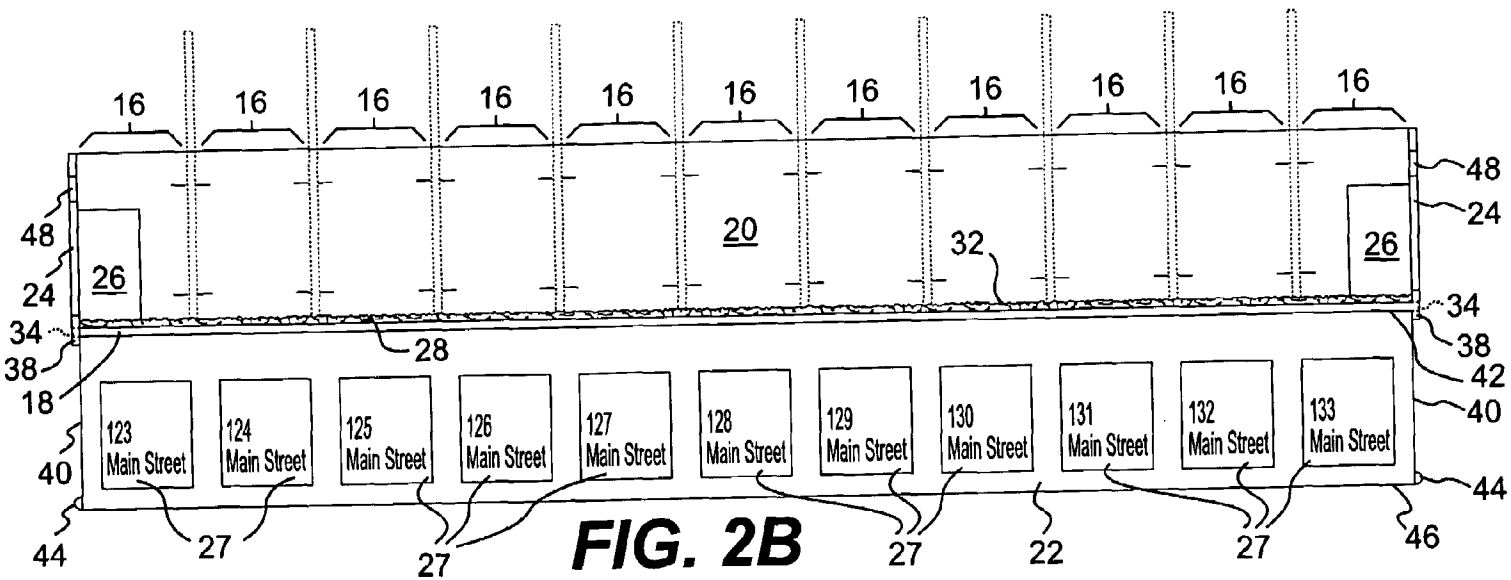
FIG. 2B is a front view illustration of a tray according to an exemplary disclosed embodiment.

Base 18 may be a planar rectangular-shaped part having a length direction and a width direction. It is also contemplated that base 18 may have a shape other than rectangular such as, for example, square, triangular, round, or any other shape known in the art. As best illustrated in FIG. 2A, base 18 may have an inner surface 28 and an outer surface 30. Inner surface 28 may be textured to include raised protrusions 32. When the inner surface 28 is textured, frictional engagement with articles and components of the device in contact with that surface restrains movement of such articles and components across the surface of the inner surface 28. As illustrated in FIGS. 2A and 2B, base 18 may also include two receiving members 34 on an outer edge 36 (only one shown in FIG. 2A). Receiving members 34 may include cylindrical hollow portions spaced apart from each other along outer edge 36, one on each end of base 18. It is contemplated that more receiving members may be included than depicted, that they may be spaced at any appropriate distance along outer edge 36, or that they may alternately be located on end panels 24. The receiving member 34 may also comprise the entire length of the edge 36. The receiving member 34 may provide a hinge structure that allows the second side panel 22 to pivot about the edge 36, as depicted in FIG. 2A.

First and second side panels 20, 22 may be planar rectangular-shaped parts, each having a length generally equal to that of base 18 and a width dimension less than the length dimension. It is also contemplated that the width dimension may be greater than the length dimension and that first and second side panels 20, 22 may have a shape other than rectangular such as, for example, trapezoidal, square, or any other appropriate shape.

Second side panel 22 may include a pin 38 on each end 40, near an outer edge 42. Pins 38 may be assembled within receiving members 34 to allow second side panel 22 to rotate relative to base 18. Second side panel 22 may have a first position where second side panel 22 is substantially orthogonal to base 18 and a generally closed four-sided structure is formed that includes first and second side panels 20, 22 and end panels 24. Second side panel 22 may also have a second position where second side panel 22 is again substantially orthogonal to base 18 and a generally open three-sided structure is formed that includes first side panel 20 and end panels 24. Second side panel 22 may be configured to rotate through approximately 180 degrees between the first and second positions. It is also contemplated that receiving members 34 may alternately be located on second side panel 22, and pins 38 located on base 18.

Second side panel 22 may also include a means for retaining second side panel 22 in the first position. In particular, second side panel 22 may include one or more protrusions 44 located on ends 40 toward an outer edge 46 that interact with end panels 24.

End panels 24 may be planar rectangular-shaped parts having a length generally equal to the width of base 18 and a width generally equal to the width of first and second side panels 20, 22. End panels 24 may include recesses 48 located toward ends 50 of end panels 24 and arranged to align with protrusions 44 when second side panel 22 is in the first position, as depicted in FIG. 1. In such an embodiment the side panel 22 is restrained in the first position but can readily be pivoted to the position shown in FIG. 2A. End panels 24 may be configured to flex away from second side panel 22 as second side panel 22 is pivoted towards or away from the first position and protrusions 44 contact end panels 24. During flexure, a force may be applied by end panels 24 to second side panel 22 that resists movement of second side panel 22 towards or away from the first position. It is contemplated that another means for retaining second side panel 22 in the first position may be implemented such as, for example, a latch, a spring-loaded pin, or another means known in the art.

Retaining members 26 may be generally planar rectangular-shaped parts spaced a distance apart from first side panel 20 to allow divider assembly 14 to be slidably positioned between retaining members 26 and first side panel 20 by hand. It is contemplated that a greater or lesser number of retaining members 26 may be included in tray 12 than depicted in the accompanying illustrations and that tools may alternately be required to slidably position divider assembly 14 within tray 12. It is also contemplated that retaining members 26 may be connected to only one of base 18 or end panels 24. Alternately, retaining members 26 may be absent and another means for retaining divider assembly 14 within tray 12 implemented such as, for example, protrusions extending from divider assembly 14 configured to engage recesses within tray 12, fasteners, or other means known in the art.

As illustrated in FIG. 2B, a plurality of labels 27 may be secured to an inner surface of second side panel 22, each label 27 being aligned with one of divisions 16. Labels 27 may have multiple pieces of information including, for example, an address number and a street name. Labels 27 may be arranged on the inner surface of second side panel 22 such that when second side panel 22 is in the open or second position, the address number or first line of information is nearest base 18 and is readable from outside of tray 12. It is contemplated that labels 27 may correspond to one address or a range of addresses, that address labels 27 may have more or less information than depicted, that each label may be color-coded, that a single level having a plurality of sections may alternately be included, and that each label 27 may be disposed on an outer surface of side panel 22 or any other surface of tray 12 or divider assembly 14.

Figure 3:
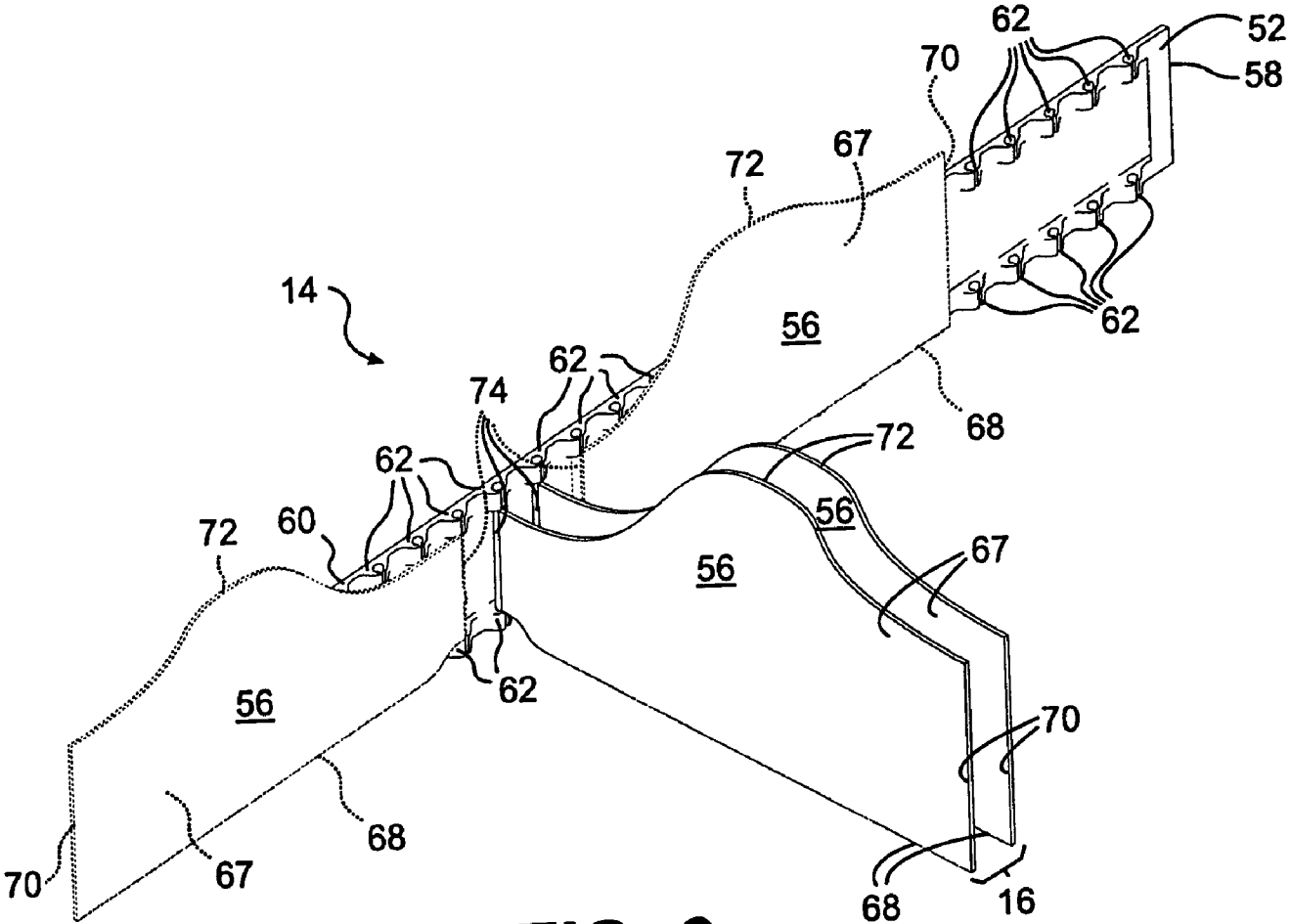
FIG. 3 is a pictorial illustration of a divider assembly according to an exemplary disclosed embodiment.

FIG. 3 illustrates divider assembly 14 having a spine 52 and a plurality of dividers 56 connected to spine 52. Divider assembly 14 may be removably and slidably connected to tray 12 and dividers 56 may be pivotally connected to spine 52. Dividers 56 may be configured to pivot through approximately 180 degrees between an orthogonal position and an aligned position relative to spine 52. It is also contemplated that dividers 56 may be limited to a pivot range of approximately 90 degrees. It is further contemplated that spine 52 and dividers 56 may be formed as a single unit and/or that dividers 56 may be rigidly fixed to spine 52.

Spine 52 may be a planar rectangular-shaped part having a length direction extending between a first end 58 and a second end 60 and a width direction orthogonal to the length direction. It is also contemplated that spine 52 may have a shape other than rectangular such as, for example, square, triangular, round, or any other shape known in the art. When fully assembled, first and second ends 58, 60 may be restrained between retaining members 26 and second side panel 22 to impede movement of spine 52 relative to tray 12.

Figure 4:
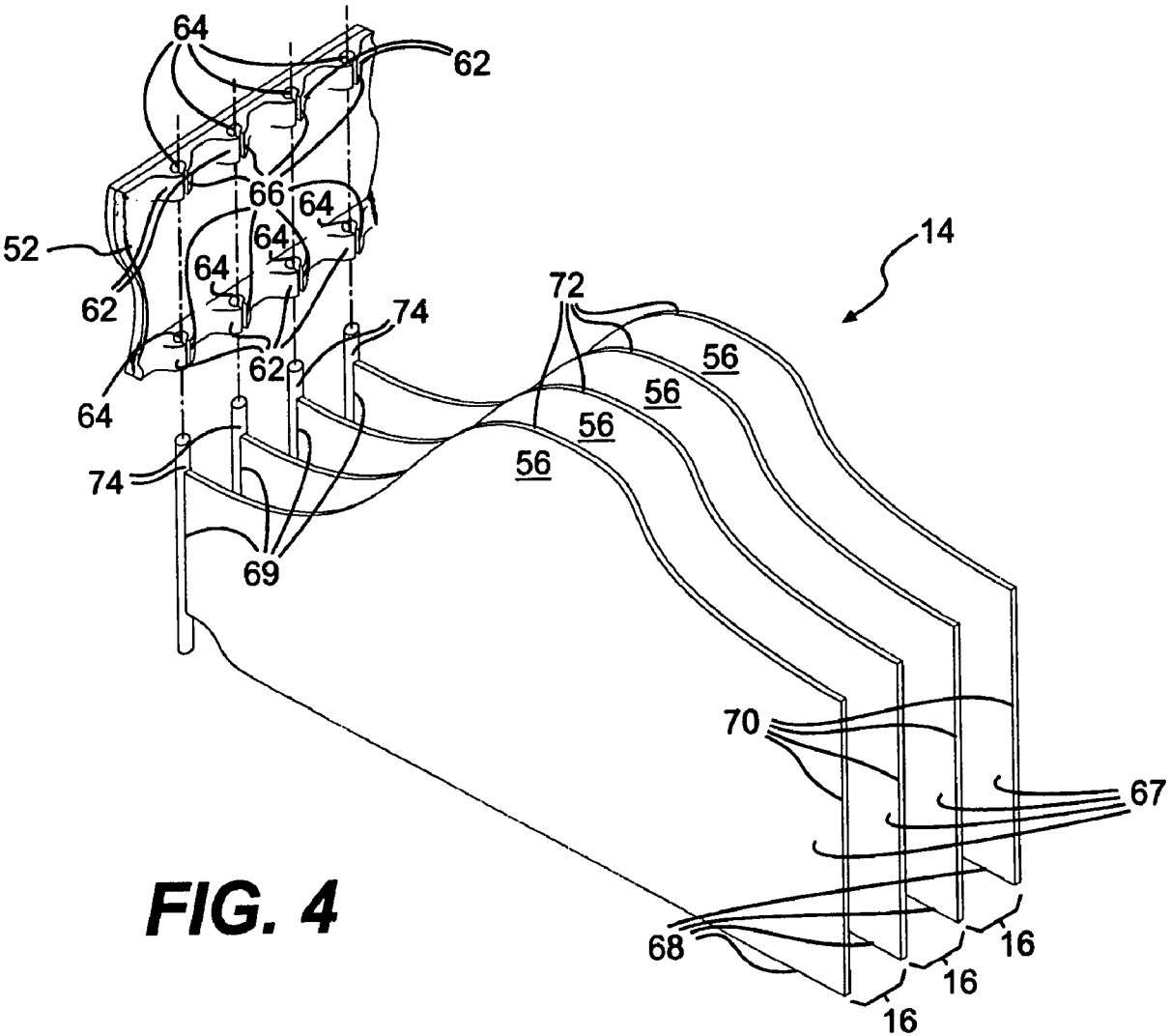
FIG. 4 is an exploded view illustration of a divider assembly according to an exemplary disclosed embodiment.

As illustrated in FIG. 4, spine 52 may have an inner surface having a plurality of protruding hinges 62, one pair of protruding hinges 62 being arranged to slidably receive each divider 56. Protruding hinges 62 may include a central through hole 64 and a channel 66 aligned with hole 64 and extending from an outer surface of protruding hinge 62 to hole 64 along the entire length of hole 64. One of the pair of protruding hinges 62 may be disposed towards one side of first side panel 20 and the second towards an opposite side of first side panel 20 with a pivot space between.

Dividers 56 may be removably connected to spine 52 and may include a generally planar portion 67 and a cylindrical pivot pin 74 connected to a side edge 69 of planar portion 67. Planar portion 67 may have a bottom edge 68, a second side edge 70 opposite side edge 69, and a top edge 72. Bottom edge 68 may be generally straight and have a length approximately equal to the width of base 18. Side edges 69 and 70 may also be generally straight and have a length approximately equal to a width of first side panel 20. Pivot pin 74 may be disposed on side edge 69. Top edge 72 may be curved and extend above side edges 69 and 70 relative to bottom edge 68. Curved top edge 72 may provide support to articles placed within divisions 16 that extend past first and second side panels 20,22. It is contemplated that top edge 72 may alternately be generally straight and have a width generally equal to a width of side edges 69 and 70 to facilitate stacking of one tray assembly 10 on top of another tray assembly 10.

Dividers 56 may be assembled to spine 52 by axially aligning pivot pin 74 with a pair of protruding hinges 62, aligning planar portion 67 with channel 66, and applying force by hand sufficient to slidably insert pivot pin 74 within the pair of protruding hinges 62. It is also contemplated that a tool (not shown) may be used to slidably insert pivot pin 74. It is further contemplated that pivot pin 74 may alternately be snapped into and out of place relative to protruding hinges 62 by applying a force in a direction orthogonal to the inner surface of spine 52. When assembled, pivot pin 74 may be configured to rotate within protruding hinges 62. When divider assembly 14 is assembled within tray 12, dividers 56 may engage protrusions 32 to reduce undesired pivoting of dividers 56. It is contemplated that a locking portion (not shown) may be implemented to lock pivot pin 74 within protruding hinges 62 to prevent disengagement.

Industrial Applicability

The disclosed tray assembly may be applicable to any sorting or delivery process where it is advantageous to accurately sort articles into related divisions. Accurately sorting articles into related divisions and retaining the sorting integrity throughout the sorting and delivery processes may reduce the time associated with the processes. Keeping the divider assembly together with the tray during delivery may reduce the need to re-sort the articles, thereby improving efficiency. The use of tray assembly 10 will now be discussed in detail.

The sorting process may begin by customizing the configuration of tray assembly 10 for a particular sorting task. One group of articles to be sorted may include articles of different sizes with different division size requirements. These different size requirements may be accommodated by adding or removing dividers 56 from spine 52. For example, a smaller division 16 may be created by inserting one or more dividers 56 into spine 52. A wider division 16 may be created by removing one or more dividers 56 from spine 52. After configuring divider assembly 14 for a particular sorting task, divider assembly 14 may be inserted into tray 12. It is also contemplated that configuration of divider assembly 14 may be initiated after insertion of divider assembly 14 into tray 12.

Initiation of the sorting process may also include applying labels 27 to the inner surface of second side panel 22. Labels 27 may be applied when second side panel 22 is in either the first or second position. It is contemplated that the labels may remain on a particular tray assembly 10 and/or that the configuration of the particular tray assembly 10 may remain the same when the particular tray assembly 10 is repeatedly used for the same sorting task. It is also contemplated that labels 27 may be absent.

Once tray assembly 10 is prepared for a particular sorting task, second side panel 22 may be moved to the second position to facilitate the placement of articles within divisions 16 and to reveal labels 27. Each article may be placed within one of divisions 16 according to a relationship between the article and the label 27 associated with a particular division 16. For example, the articles may include pieces of mail and the labels may include addresses. A piece of mail may be placed within a division 16 having the same address as the destination address indicated on the piece of mail.

When the mail has been sorted into the appropriate divisions 16, second side panel 22 may be moved to the first position and snapped into place by engaging protrusions 44 with recesses 48. In this manner, the sorted articles may be retained within tray assembly 10.

After the sorting task is complete, tray assembly 10 may be loaded on a vehicle for delivery directly from tray assembly 10. Several tray assemblies 10 corresponding to different destinations for a same general area may be loaded on the same vehicle for delivery by a single mail carrier. When delivering directly from tray assembly 10, divider assembly 14 may remain within tray 12 to facilitate quick and efficient delivery of the mail. As the mail carrier deliveries the mail from one division 16, divider 56 defining one border of that division 16 may be pivoted away from the undelivered divisions 16, thereby allowing easy access to the next division 16. After a first tray assembly 10 has been emptied, divider assembly 14 may be removed from tray 12 to facilitate nesting of a second tray assembly 10 within the first. It is also contemplated that divider assembly 14 may remain within tray 12 during nesting.

Alternately, the mail sorted within tray assembly 10 may be transferred to a mail bag for foot delivery. During transfer, divider assembly 14 may be removed for easy access to the sorted mail within tray assembly 10 by sliding spine 52 out from between retaining members 26 and first side panel 20. The sorted mail may then be removed from tray assembly 10 and placed within the mail bag in the order removed from tray assembly 10. During delivery, the mail carrier may finger through the sorted mail, retrieving a single division worth of mail at a time for delivery.

It will be apparent to those skilled in the art that various modifications and variations can be made to the disclosed tray assembly without departing from the scope of the invention. Other embodiments will be apparent to those skilled in the art from consideration of the specification. For example, tray assembly 10 may include a means for strengthening such as corrugations, creases, additional support members, or another means known in the art. Tray assembly 10 may also include one or more handles to facilitate transportation of tray assembly 10, a lid to prevent spillage of articles retained within tray assembly 10, additional tray label holders, tapered sides to facilitate nesting, or other suitable features. It is intended that the specification and examples be considered as exemplary only, with a true scope of the invention being indicated by the following claims and their equivalents.

What is claimed is:

1. A tray assembly, comprising:

a tray including:

a base;

a first side fixedly attached to the base;

a second side fixedly attached to the base and the first side;

a third side opposite the first side and fixedly attached to the base and the second side; and a fourth side opposite the second side and pivotally connected to the base; and a divider assembly removably connected to the tray and including:

a spine; and a plurality of dividers, each being removably connected to the spine and configured to pivot relative to the spine; and a plurality of protrusions disposed on an inner surface of the base and configured to impede pivoting of the plurality of dividers.

2. The tray assembly of claim 1, further including at least one retaining member fixedly connected to the tray and configured to retain the divider assembly.

3. The tray assembly of claim 1, wherein the at least one retaining member includes a protrusion connected to the base and one of the first and third sides, the protrusion being spaced from the second side and the divider assembly being configured for assembly between the protrusion and the second side.

4. The tray assembly of claim 1, further including:

a pin portion disposed on each of the plurality of dividers; and a receiving portion disposed on the spine and configured to slidably receive the pin portion, wherein the pin portion is configured to rotate relative to the receiving portion.

5. The tray assembly of claim 1, wherein each of the plurality of dividers is configured to pivot between a generally orthogonal position and a generally aligned position relative to the second side when assembled.

6. The tray assembly of claim 1, further including a label disposed on an inner surface of the fourth side, wherein the plurality of dividers form a plurality of divisions within the tray assembly and the label includes a plurality of separate sections of information, each of the plurality of separate sections aligned with one of the plurality of divisions.

7. The tray assembly of claim 1, wherein each of the plurality of dividers includes a curved portion extending beyond the second side relative to the base when assembled.

8. The tray assembly of claim 1, wherein the fourth side is configured to pivot between a first position where a generally closed four-sided structure is formed and a second position where a generally open three-sided structure is formed.

9. The tray assembly of claim 8, wherein the fourth side includes at least one protrusion configured to engage a recess in at least one of the first and third sides to retain the fourth side in the first position.

10. A method of sorting, comprising:

providing a divider assembly having a plurality of divider panels that form a plurality of divisions therebetween;

placing the divider assembly within a tray having a base, a first side, a second side, a third side, and a fourth side to form a plurality of divisions within the tray;

pivoting the fourth side from a first position where a generally closed four-sided structure is formed to a second position where a generally open three-sided structure is formed to reveal a label disposed on an inner surface of the fourth side, wherein the label includes a plurality of separate sections of information, each of the separate sections of information being aligned with one of the plurality of divisions;

placing articles within at least one of the plurality of divisions, each of the articles placed within the at least one of the plurality of divisions being related to the one of the plurality of sections of information aligned with the at least one of the plurality of divisions; and returning the fourth side to the first position.

11. The method of claim 10, further including retaining the divider assembly with at least one retaining member connected to the tray and spaced a distance from the second wall.

12. The method of claim 11, further including removing the divider assembly from the tray by sliding the divider assembly from between the retaining member and the second wall.

13. The method of claim 10, further including engaging at least one protrusion disposed on the fourth side with a recess disposed in at least one of the first and third sides to retain the fourth side in the first position.

14. The method of claim 10, further including removing one or more of a plurality of dividers from the divider assembly to increase a size of at least one of the plurality of divisions.

15. The method of claim 10, further including installing one or more of a plurality of dividers in the divider to decrease a size of at least one of the plurality of divisions.

16. The method of claim 10, further including pivoting at least one of a plurality of dividers included in the divider assembly between a generally orthogonal position and a generally aligned position relative to the second side when the divider assembly is assembled within the tray.

17. A tray assembly, comprising:

a tray including:

a base;

a first side fixedly attached to the base;

a second side fixedly attached to the base and the first side;

a third side opposite the first side and fixedly attached to the base and the second side; and a fourth side opposite the second side and pivotally connected to the base, a divider assembly removably connected to the tray and including:

a spine; and a plurality of dividers, each being removably connected to the spine and configured to pivot relative to the spine;

at least one retaining member fixedly connected to the tray and configured to retain the divider assembly; and a label disposed on an inner surface of the fourth side, wherein the plurality of dividers form a plurality of divisions within the tray assembly and the label includes a plurality of sections of information, each of the plurality of sections of information being aligned with one of the plurality of divisions.

* * * * *